United States Patent [19]

Pastor

[11] Patent Number: 4,878,870

[45] Date of Patent: Nov. 7, 1989

[54] ALL-FOURS WALKING DOLL

[75] Inventor: Vincente N. Pastor, Onil, Spain

[73] Assignee: Vicma, S.A., Onil, Spain

[21] Appl. No.: 158,254

[22] Filed: Feb. 19, 1988

[51] Int. Cl.[4] ..... A63H 3/28; A63H 3/24; A63H 3/22

[52] U.S. Cl. ..... 446/298; 446/306; 446/317; 446/356

[58] Field of Search ..... 446/311, 312, 317, 324, 446/330, 352, 353, 354, 355, 356, 358, 305, 270, 298, 377, 379, 390

[56] References Cited

U.S. PATENT DOCUMENTS

| | | | |
|---|---|---|---|
| 2,761,243 | 9/1956 | Baggott | 446/377 |
| 2,978,834 | 4/1961 | Gardel et al. | 446/356 |
| 3,514,899 | 6/1920 | Bonanno et al. | 446/298 |
| 3,548,537 | 12/1970 | Robbins | 446/355 |
| 3,851,418 | 12/1974 | Barlow et al. | 446/354 |
| 4,312,150 | 1/1982 | Terzian | 446/354 |
| 4,613,315 | 9/1986 | Kataoka | 446/355 |

*Primary Examiner*—Robert A. Hafer
*Assistant Examiner*—Michael Brown
*Attorney, Agent, or Firm*—Ladas & Parry

[57] ABSTRACT

The present invention is related to a doll, standing on its hands and knees, in an all-fours position, having inside it a battery-fed mechanism, which, by means of a cam-connecting rod combination, makes the doll advance on the ground and temporarily extends its hands frontwards in a headlong-falling attitude, at the same time as it connects a sound mechanism that reproduces a baby's weeping, going back to the initial all-fours position in order to develop the complete cycle of the mechanism.

5 Claims, 4 Drawing Sheets

ALL-FOURS WALKING DOLL

The object of the present invention is a doll having its body in an all-fours position, for which it is provided with a mechanism hidden inside its body, that transmits combined movement to the arms and legs in order to attain its advance on the ground.

Different mechanisms are well-known in the art through which said movement of the doll arms and legs for the advance thereof is produced.

In most cases, the mechanisms are located inside the body, more specifically inside the the doll trunk and mainly consist of a set of reducing gears that, through corresponding handles, act on the inner end of the arms at the shoulder level, this movement being related, by means of connecting rods, to the legs, at their inner part at the hip articulation level.

The arms have a support position on the ground. The legs are bent so that the support is made in this case on the knees.

The attraction that these dolls hold out for children as they watch them going on all-fours, comes out to be rather monotonous after some time.

Due to that, new effects have been tested that increase the attraction for children of this kind of all-fours walking dolls. With this aim, the mechanism has been provided with some elements that, in a temporized and temporary way, modify the walking effect by the headlong-falling one. So that this happens, the doll body has been shaped in an especial way, it has been given an arched shape, so that it really falls on the thorax in the headlong-falling movement.

So that this effect is produced, it has been established that, in a certain moment, the arms make a rotation movement over the shoulders, extending themselves frontwards.

The elements favouring this action operate, besides, on a phonographic reproducer or the like. In combination with the doll headlong-falling position, the reproducer starts functioning, a baby's weeping sound being then audible, the effectiveness degree being thus increased.

The continuation of the mechanism movements in a complete cycle comprises the return to the normal all-fours walking position of the doll, combined with the interruption of the sound mechanism operation.

For a better comprehension of the object of the invention, some drawings are hereto attached wherein a mechanism helping, in an exemplary way, to reach the proposed aim, is represented. It does not imply that the advance of technology will not allow to use other simpler mechanisms even for attaining the same purpose.

Figure 1:
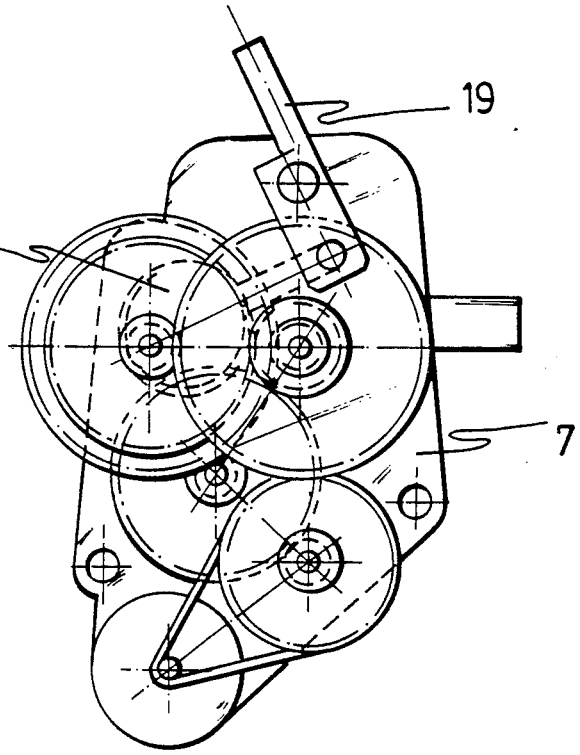
Figure 2:
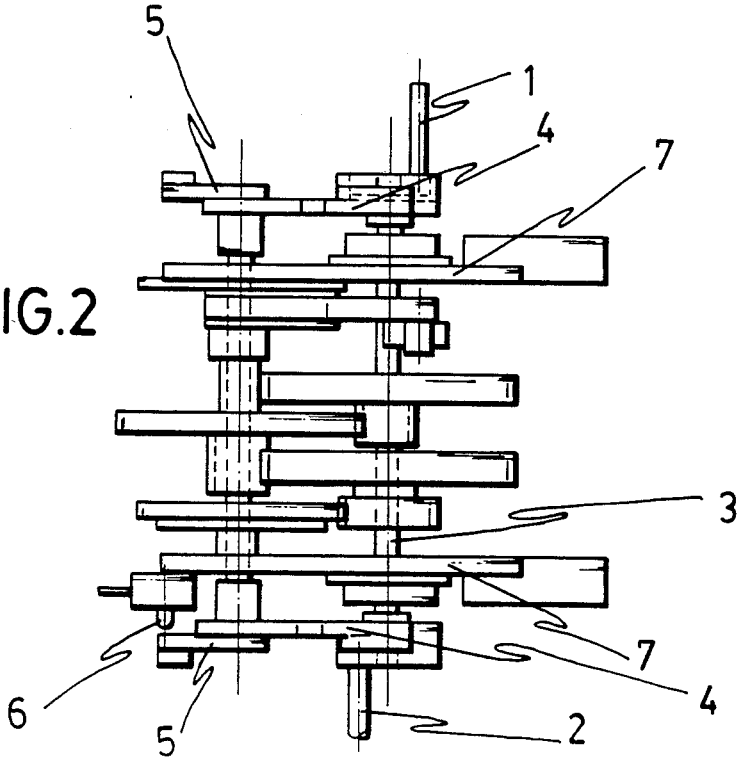

Reference being thus made to the drawings, FIG. 1 represents a side elevational view of said mechanism and FIG. 2 the top view of the mechanism, showing the main shafts with all their attached elements. The peculiarity of this mechanism becomes more definite in the combination with the handles 1 and 2 of the conducted shaft 3, of the plates 4 which are freely coupled on the shaft and related to the doll arms, as well as to the arched cam 5, in the lateral action field of which is the pulsator 6, which closes temporarily the sound reproducer circuit. The supports 7 bear the whole mechanism inside the body of the doll.

As seen in FIG. 1, a pulley is connected to one of the gears in the mechanism so that the battery fed mechanism, which moves the pulley, causes the interconnected gears and cams in the mechanism to rotate. The rotation of these cams and gears then causes cam 5 to rotate and stem 19 to pivot.

Figure 3:
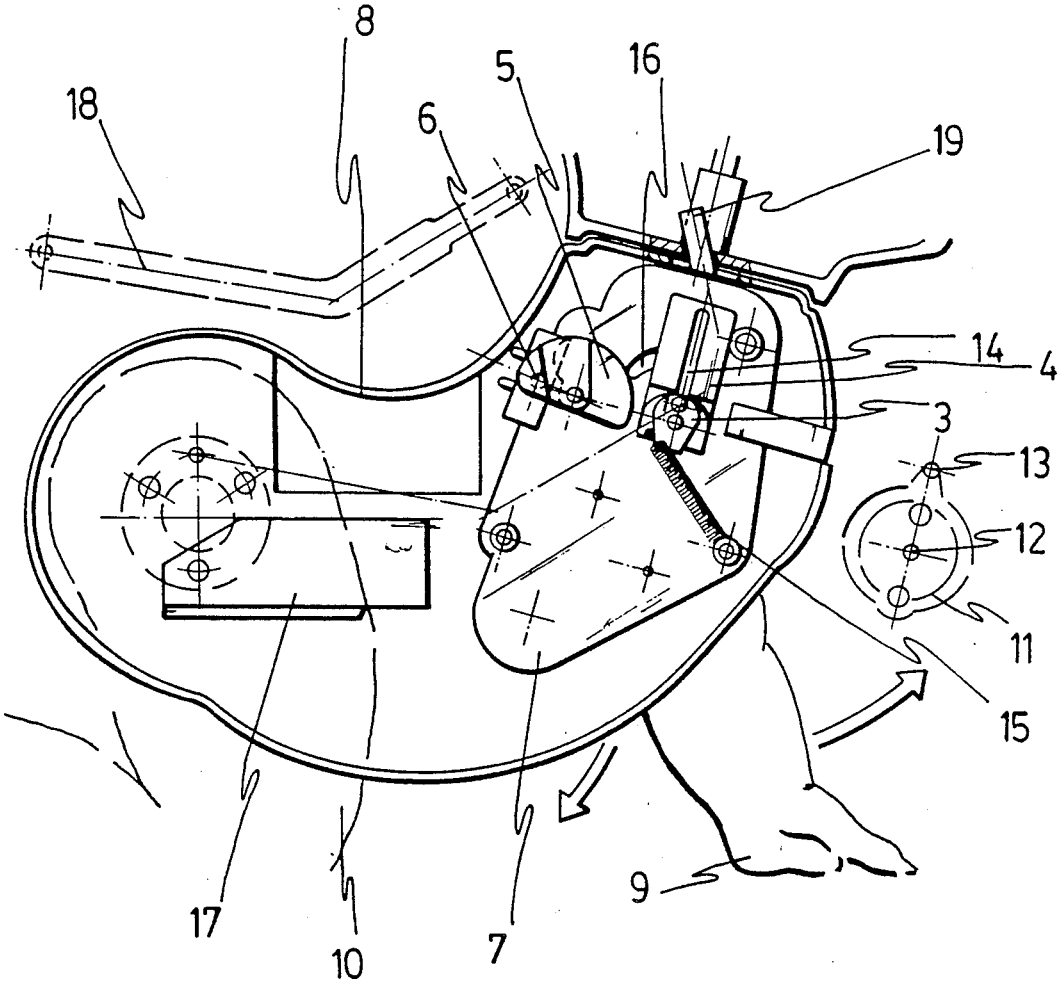
Figure 4:
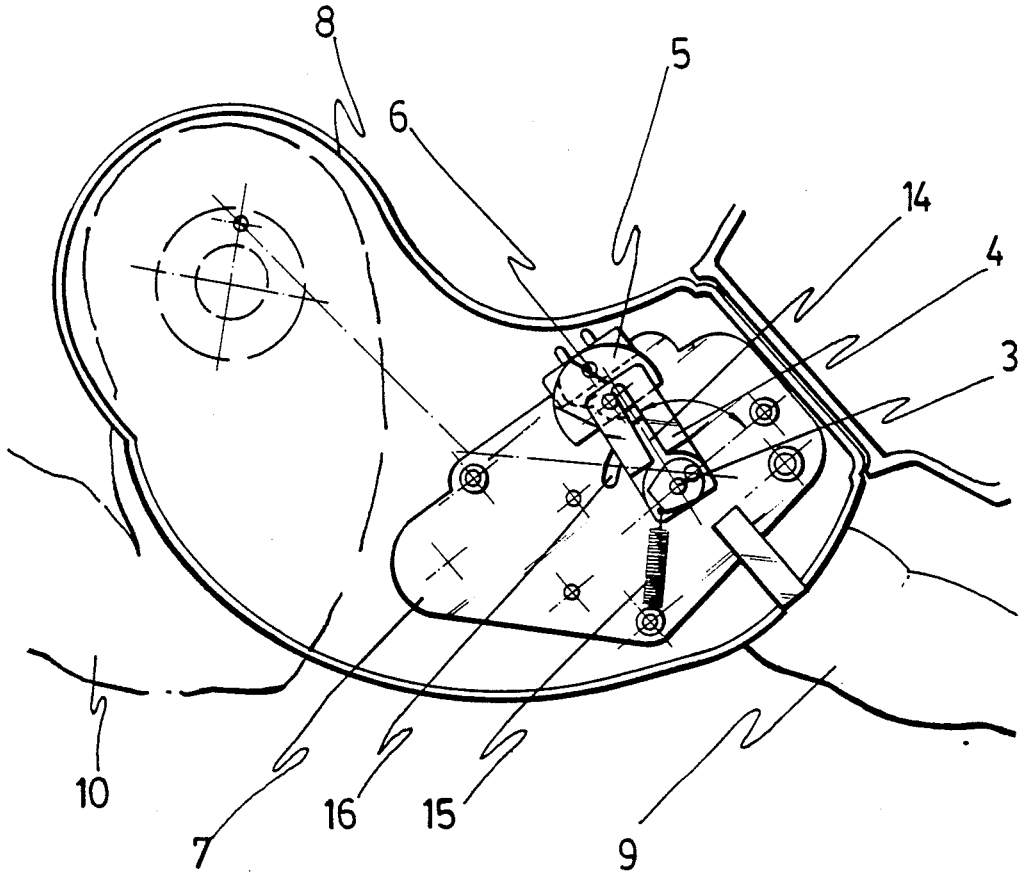

FIG. 3 represents schematically the doll body, inside which the mechanism is situated. Such as it can be seen in this figure, the doll body 8 has its trunk in an arched position and in an all-fours walking attitude, leaning on the hands 9 and on the knees 10 of its bent legs. By means of the mechanism, the arms and the legs perform a movement that determines the displacement of the doll. The piece 11 corresponds to the terminal of the arms. At the point 12 of the piece 11 is the conducted shaft 3, whilst the pivot 13 is inserted in the slot 14 of the corresponding plate 4. These plates, by virtue of said assembly, become themselves an extension of the arms. Spring 15, connected to the plate 4 as shown in FIGS. 3 and 4, causes appendix 16 to be urged against the convex portion of arched cam 5 when the arms of the doll are in a generally upright position. As the battery fed mechanism causes arched cam 5 to be rotated, appendix 16 approaches the flat portion of cam 5. Once appendix 16 reaches the flat portion of cam 5, appendix 16 becomes disengaged from cam 5 as shown in FIG. 4. As the appendix becomes disengaged from cam 5, spring 15 pivots plate 4 in a downward direction thereby causing the arms, connected to the plate, to extend forward. A headlong-falling movement of the doll is thereby produced. In addition, a non-pulsating zone of the arched cam 5 contacts pulsator 6 so as to close a switching mechanism in the pulsator and cause the sound reproducer 17 to be turned on.

As the cam is further rotated, the convex portion again engages appendix 16 so as to pivot the plate in an upward direction thereby causing the arms of the doll to be positioned in an upright direction. To enhance the forward moving action of the arms, connecting rod 18 is connected to the handles and the legs so that the movement of the plate will cause a corresponding movement in the legs which simulates the crawling motion of a baby.

FIG. 4 shows the doll in the headlong fallen position. It is assumed that the baby it represents was not strong enough to continue walking on all-fours and has stretched out his arms. Coinciding with this position, the arched cam 5 acts by one of its sides against the pulsator 6, thereby closing the sound reproducer circuit.

Figure 5:
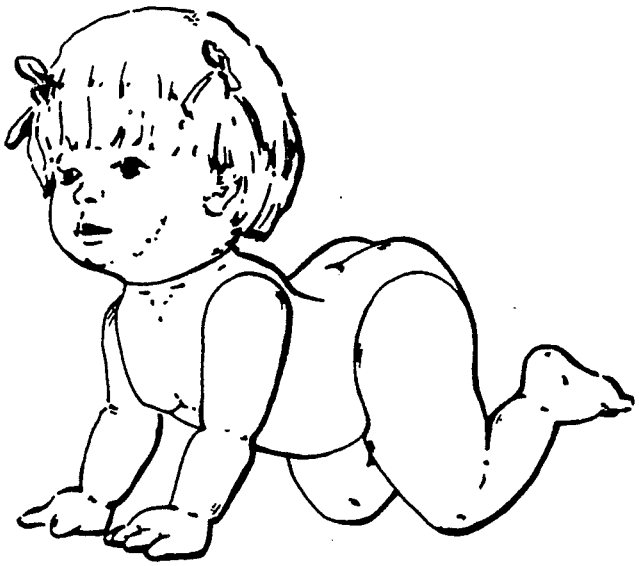
Figure 6:
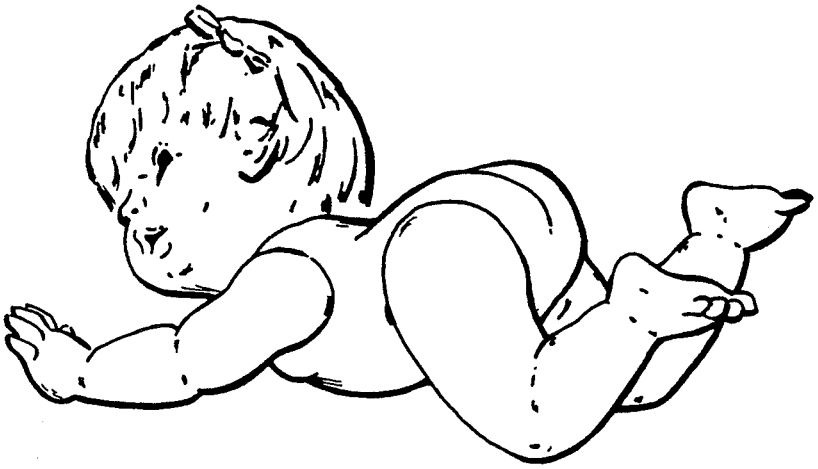

FIG. 5 shows the doll in the all-fours walking position and, finally, FIG. 6 shows it in the headlong-fallen position.

The doll will naturally be dressed as necessary in order to give it the appearance one wishes at each given moment.

In FIGS. 1, 2 and 4 there appears a stem 19 driven by the eccentric 20, the aim of which is to make the doll head oscillate alternatively towards both sides by a track means in the doll head that translates the pivoting motion of the stem into a swiveling head motion. This track means is best shown in FIG. 3.

Summing up, the Patent of Invention on file must fall onto the following claims.

I claim:

1. An all-fours walking doll toy that periodically falls down on a horizontally disposed body portion comprising:

movable arm and leg parts, connected to the body portion, that support the body portion and cause the doll to walk on all-fours;

an electrically powered drive mechanism within the body connected to at least one rotatable cam having a convex surface and a flat surface;

at least one rotatable plate connected to the drive mechanism and the arm part of the doll so as to cause the arm part to move, said rotatable plate is movable between a first position in which an elastic means within the body portion and connected to the plate urges an appendix of the plate against the convex surface of the cam so as to maintain the arm part in a generally upright position, and a second position in which the appendix loses contact with the cam when the rotation of the cam by the drive mechanism causes the flat surface of the cam to be positioned adjacent to the appendix so that the elastic means can rotate the plate and cause the arm part to extend forward so that the doll acquires a headlong-fallen position;

a swivel mechanism connected to the drive mechanism and a head part of the doll so as to cause the head part to alternately swivel sideways as the doll walks on all-fours; and a connecting, means between the plate and the leg part, so as to move the leg part in conjunction with the arm part.

2. An all-fours walking doll toy according to claim 1, wherein a sound reproducer within the body portion, to produce the weeping sounds of a baby, is turned on when a switching portion of the cam contacts and closes a switch connected to the sound reproducer and turns off when the switching portion loses contact with the switch.

3. All-fours walking doll toy, according to claim 2, wherein a trunk portion of the body portion has an arched shape, so that the head part stands extended frontwards in the all-fours walking-on position, while in the headlong-fallen position it is slightly lifted up with respect to the ground, while the trunk portion remains close to the ground.

4. An all-fours walking doll toy according to claim 2, wherein the cam is mounted on a first axle of the drive mechanism that is parallel to a second axle of the drive mechanism that is connected to the plate, said plate having a slot formed thereon that is engageable by a pivot connected to the arm part.

5. An all-fours walking doll toy according to claim 4, wherein said swivel mechanism includes a pivotable stem attached to an eccentric part in the drive mechanism that causes the stem to move, said stem is engageable with a track means in said head part so that the pivoting of the stem causes the head part to rotate sideways.

* * * * *